United States Patent [19]

Ishioka et al.

[11] 4,365,013

[45] Dec. 21, 1982

[54] ELECTROPHOTOGRAPHIC MEMBER

[75] Inventors: Sachio Ishioka, Tokyo; Eiichi Maruyama, Kodaira; Yoshinori Imamura, Hachioji; Hirokazu Matsubara, Hamuramachi; Shinkichi Horigome, Tachikawa, all of Japan

[73] Assignee: Hitachi, Ltd., Tokyo, Japan

[21] Appl. No.: 287,633

[22] Filed: Jul. 28, 1981

[30] Foreign Application Priority Data

Jul. 28, 1980 [JP] Japan ..... 55-102530

[51] Int. Cl.[3] ..... G03G 5/08

[52] U.S. Cl. ..... 430/57; 204/192 P; 252/501.1; 427/39; 427/74; 430/84

[58] Field of Search ..... 427/39, 74; 252/501.1; 204/192 P; 430/57, 84

[56] References Cited

U.S. PATENT DOCUMENTS

| | | | |
|---|---|---|---|
| 4,226,643 | 10/1980 | Carlson | 427/39 X |
| 4,265,991 | 5/1981 | Hirai et al. | 204/192 P X |
| 4,289,822 | 9/1981 | Shimada et al. | 427/74 |
| 4,297,392 | 10/1981 | Higashi et al. | 427/39 X |

*Primary Examiner*—Bernard D. Pianalto

*Attorney, Agent, or Firm*—Antonelli, Terry and Wands

[57] ABSTRACT

Disclosed is an electrophotographic member having at least a supporter and a photoconductor layer formed mainly of amorphous silicon, characterized in that the amorphous silicon contains at least 50 atomic-% of silicon and at least 1 atomic-% of hydrogen as an average within the layer, and that a part which is at least 10 nm thick from a surface or/and interface of the photoconductor layer toward the interior of the photoconductor layer has a hydrogen content in a range of at least 1 atomic-% to at most 40 atomic-% and an optical forbidden band gap in a range of at least 1.3 eV to at most 2.5 eV and also has the property that an intensity of at least one of peaks having centers at wave numbers of approximately 2,200 $cm^{-1}$, approximately 1,140 $cm^{-1}$, approximately 1,040 $cm^{-1}$, approximately 650 $cm^{-1}$, approximately 860 $cm^{-1}$ and approximately 800 $cm^{-1}$ in an infrared absorption spectrum as are attributed to a bond between silicon and oxygen does not exceed 20% of a higher one of intensities of peaks having centers at wave numbers of approximately 2,000 $cm^{-1}$ and approximately 2,100 $cm^{-1}$ as are attributed to a bond between silicon and hydrogen. Dark decay characteristics are good, and a satisfactory surface potential can be secured. In addition, the characteristics are stable versus time.

7 Claims, 10 Drawing Figures

ELECTROPHOTOGRAPHIC MEMBER

BACKGROUND OF THE INVENTION

1. Field of the Invention

This invention relates to improvements in an electrophotographic member which employs amorphous silicon as a photoconductive material.

2. Description of the Prior Art

As photoconductive materials to be used for electrophotographic members, there have heretofore been inorganic substances such as Se, CdS and ZnO and organic substances such as poly-N-vinyl carbazole (PVK) and trinitrofluorenone (TNF). They exhibit high photoconductivities. However, in case of forming photoconductive layers by using these materials as they are or by dispersing the powders thereof in binders of organic substances, there has been the disadvantage that the layers exhibit insufficient hardnesses, so they have their surfaces flawed or wear away during the operations as the electrophotographic members. In addition, many of these materials are substances harmful to the human body. It is therefore unfavorable that the layers wear away to adhere on copying paper even if in small amounts. In order to improve these disadvantages, it has been proposed to employ amorphous silicon for the photoconductive layer (Japanese Laid-open Patent Application No. 54-78135). The amorphous silicon layer is higher in hardness than the aforecited conventional photoconductive layers and is scarcely toxic, so that the disadvantages of the conventional photoconductive layers are improved. The amorphous silicon layer, however, exhibits a resistivity in dark which is too low for the electrophotographic member. The amorphous silicon layer having a high resistivity on the order of $10^{10}$ Ω·cm exhibits a gain being too low, and only an unsatisfactory one is obtained as the electrophotographic member. In order to overcome this disadvantage, there has been proposed a layer structure wherein at least two sorts of amorphous silicon layers having different conductivity types such as the n-type, $n^+$-type, p-type, $p^+$-type and i-type are formed into a junction and wherein photo-carriers are generated in a depletion layer formed in the junction part (Japanese Laid-open Patent Application No. 54-121743). However, in case where the depletion layer is formed by putting the two or more layers of the different conductivity types into the junction in this way, it is difficult to form the depletion layer in the surface of the photoconductive layer. Therefore, the important surface part of the photoconductive layer which must hold a charge pattern exhibits a low resistivity to give rise to the lateral flow of the charge pattern. It is consequently feared that the resolution of electrophotography will degrade.

SUMMARY OF THE INVENTION

This invention has for its object to provide an electrophotographic member employing amorphous silicon which has good dark decay characteristics and a high photosensitivity. The characteristics of the electrophotographic member are very stable versus time.

In order to accomplish the object, the electrophotographic member of this invention is constructed as follows:

(1) A photoconductive layer of the electrophotographic member is made of amorphous silicon. Preferable as the hydrogen content of the layer is 1 atomic-% to 40 atomic-% in terms of the average value of the layer.

(2) A part which is at least 10 nm thick from the surface of the amorphous silicon photoconductor layer (or the interface thereof with an electrode, a blocking layer or the like) toward the interior of the photoconductor layer is made of an amorphous silicon layer which contains hydrogen in a range of at least 1 atomic-% to 40 atomic-%, whose optical forbidden band gap has a value of 1.3 eV to 2.5 eV, and which has the physical property that any of the intensities of at least ones having centers at wave numbers of approximately 2,200 $cm^{-1}$, 1,140 $cm^{-1}$, 1,040 $cm^{-1}$, 650 $cm^{-1}$, 860 $cm^{-1}$ and 800 $cm^{-1}$ among infrared absorption peaks attributed to the bond between silicon and oxygen in the layer does not exceed, from the beginning (or owing to a change with the lapse of time), 20% of the intensity of a greater one of peaks at approximately 2,100 $cm^{-1}$ or approximately 2,000 $cm^{-1}$ attributed to the stretching vibration of the bond between silicon and hydrogen in the amorphous silicon.

DETAILED DESCRIPTION OF THE INVENTION

Figure 1:
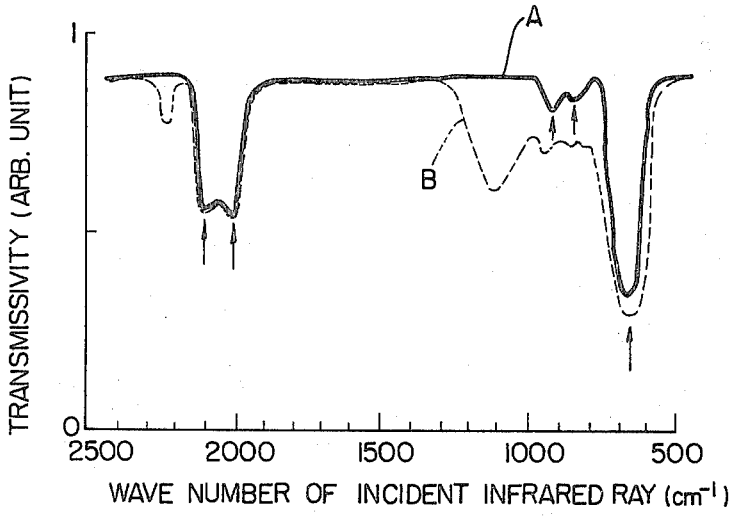
FIGS. 1 and 9 are graphs each showing the infrared absorption spectrum of amorphous silicon.

An amorphous silicon layer which is made only of the pure silicon element exhibits a high localized state density, and has almost no photoconductivity. However, the amorphous silicon layer can have the localized states reduced sharply and be endowed with a high photoconductivity by doping it with hydrogen, or it can be turned into such conductivity types as the p-type and n-type by doping it with impurities. As elements effective to reduce the localized state density in the amorphous silicon as described above, there are the elements of the so-called halogen group such as fluorine, chlorine, bromine and iodine, in addition to hydrogen. Although the halogen group has the effect of reducing the localized state density in the amorphous silicon, it cannot greatly vary the optical forbidden band gap of the amorphous silicon. In contrast, hydrogen can sharply increase the optical forbidden band gap of the amorphous silicon or can increase the resistivity thereof by doping the amorphous silicon therewith. Therefore, it is especially useful for obtaining a high-resistivity photoconductive layer.

Now, in a light receiving device of the storage mode such as the electrophotographic member, the resistivity of the photoconductive layer must satisfy the following two required values:

(1) The resistivity of the photoconductive layer needs to be above approximately $10^{10}$ Ω·cm lest charges stuck on the surface of the layer by the corona discharge or the like should be discharged in the thickness direction of the layer before exposure.

(2) Also the sheet resistance of the photoconductive layer must be sufficiently high lest a charge pattern formed on the surface of the photoconductive layer upon the exposure should disappear before developing on account of the lateral flow of the charges. In terms of the resistivity, this becomes above approximately $10^{10}$ Ω·cm as in the preceding item.

In order to meet the conditions of the two items, the resistivity of and near the surface of the photoconductive layer to store the charges must be above approximately $10^{10}$ Ω·cm, but the resistivity of at least $10^{10}$ Ω·cm need not be possessed uniformly in the thickness direction of the layer. Letting $\tau$ denote the time constant of the dark decay in the thickness direction of the layer, C denote the capacitance per unit area of the layer and R denote the resistance in the thickness direction per unit area of the layer, the following relation holds:

$$\tau = RC$$

The time constant $\tau$ may be sufficiently long as compared with the period of time from the electrification to the developing, and the resistance R may be sufficiently great with the thickness direction of the layer viewed macroscopically.

The inventors have revealed that, as a factor which determines the macroscopic resistance in the thickness direction of the layer in a high-resistivity thin-film device such as the electrophotographic member, charges to be injected from the interface with an electrode play an important role besides the resistivity of the layer itself.

To the end of blocking the injection of charges from a substrate side which supports the photoconductive layer, a method is also considered in which a junction such as p-n junction is formed in the amorphous silicon layer near the substrate and is reverse-biased by an external electric field. This method, however, is difficult of meeting the required value (2) described before.

In this invention, the surface and the substrate side interface of the amorphous silicon are constructed as described before, and the resistivity of the layer is made at least $10^{10}$ Ω·cm, whereby the problems are solved.

Ordinarily, such high-resistivity region is the intrinsic semiconductor (i-type). This region functions as a layer which blocks the injection of charges from the electrode into the photoconductive layer, and can simultaneously be effectively used as a layer which stores the surface charges. Herein, the thickness of the high-resistivity amorphous silicon layer needs to be at least 10 nm lest the charges should pass through the region due to the tunnel effect. Further, in order to effectively block the injection of the charges from the electrode, it is also effective to interpose a charge injection blocking layer of $SiO_2$, $CeO_2$, $Sb_2S_3$, $SB_2Se_3$, $As_2S_3$, $As_2Se_3$ or the like at a thickness of approximately 10–100 nm between the electrode and the amorphous silicon layer.

The localized state density in the pure amorphous silicon containing no hydrogen is presumed to be on the order of $10^{20}/cm^3$. Supposing that hydrogen atmos extinguish the localized states at 1:1 in case of doping such amorphous silicon with hydrogen, all the localized states ought to be extinguished with a hydrogen-doping quantity of approximately 0.1 atomic-%. An actual study, however, has revealed that when the hydrogen content exceeds approximately 1 atomic-%, an amorphous silicon film having a photoconductivity enough to be used for electrophotography is obtained.

Further, the inventors promoted the study. As a result, it has been revealed that when the hydrogen content of the amorphous silicon layer is too high, the characteristics of the layer are unfavorable. At a content of several atomic-%, hydrogen contained in amorphous silicon functions merely to extinguish the localized states within the amorphous silicon. However, when the content becomes excessive, the structure of the amorphous silicon itself changes and becomes the so-called polymeric structure such as (—$SiH_2$—). In this case, amorphous silicon up to approximately 65 atomic-% in terms of the hydrogen content has been produced. With the amorphous silicon of the polymer structure, however, the traveling property of carriers generated by the photo excitation has been inferior, with the result that a satisfactory photoconductivity has become unattainable. As the result of the inventors' study, the hydrogen content actually suitable for use as electrophotography has been at least 1 atomic-% and at most 40 atomic-%.

The hydrogen must bond with silicon atoms in the form of effectively extinguishing the localized states within the amorphous silicon. A good expedient for judging this point is a method in which the optical forbidden band gap is investigated. In case where the hydrogen is contained in the amorphous silicon in the form of the effective bond, the optical forbidden band gap increases with the hydrogen content. It has been verified that the optical forbidden band gap corresponding to the hydrogen content suitable for electrophotography (from 1 atomic-% to 40 atomic-%) falls in a range of from 1.3 eV to 2.5 eV.

Further, in order to hold the photoconductivity and high resistivity value of the amorphous silicon layer over a long term, the infrared absorption characteristics stated before needs to be bestowed. Shown at a solid line A in FIG. 1 is the infrared absorption curve of amorphous silicon of good quality. Absorption peaks are noted at wave numbers of approximately 2,100 $cm^{-1}$, 2,000 $cm^{-1}$, 890 $cm^{-1}$, 850 $cm^{31\ 1}$ and 640 $cm^{-1}$. (The respective absorption peaks are indicated by arrows in the figure.) All these peaks are attributed to the bond between silicon and hydrogen, and it is understood that hydrogen efficiently bonds with silicon to extinguish the localized states within the layer. Under certain conditions of production, however, even an amorphous silicon layer which exhibit apparently good characteristics at the beginning has its characteristics varied with the lapse of time. Such layer is unfavorable for an electrophotograph to undergo such severe usage as exposure to corona discharge, and especially incurs a conspicuous degradation in the dark decay characteristics.

The inventor's study has revealed that the drawback is chiefly caused by an insufficient denseness of the skeleton structure of the amorphous silicon itself. Expedients effective for finding such layer liable to vary in quality have been known. One of them is to measure the aforecited infrared absorption curve, and the other is to measure the hardness of the amorphous silicon layer.

It has been revealed that when the infrared absorption measurement is made on the amorphous silicon layer whose characteristics degrade, several peaks are observed from the beginning besides the peaks attributed to the bond between silicon and hydrogen as indicated by a broken line B in FIG. 1 or become conspicuous due to variations and increases with time. These peaks have centers at wave numbers of approximately 2,200 $cm^{-1}$, approximately 1,140 $cm^{-1}$, approximately 1,040 $cm^{-1}$, approximately 650 $cm^{-1}$, approximately 860 $cm^{-1}$ and approximately 800 $cm^{-1}$, and all are attributed to the bond between silicon and oxygen. They are somewhat different in size, and among them, the peak having the center at 1,140 $cm^{-1}$ is the most conspicuous.

As illustrated in FIG. 1, when the infrared absorption characteristics of the amorphous silicon layer are measured, the absorption peaks attributed to the bond between silicon and hydrogen are observed. Among them, the peaks at the wave numbers of approximately 2,100 $cm^{-1}$ and 2,000 $cm^{-1}$ are attributed to the stretching vibration. There has been obtained the result that when the intensity of the greatest one of the peaks based on the bond between silicon and oxygen is at most 20% in comparison with the intensity of the greater one of the peaks based on the stretching vibration, the particular amorphous silicon stably holds a high photoconductivity. This method is very greatly effective for the production of electrophotographic members because it can simply sense amorphous silicon layers of inferior quality.

Regarding oxygen, it has been reported that when oxygen is contained in a layer in such a form as being added into a reaction gas in the preparation of amorphous silicon, it contributes to an enhancement of the photoconductivity of the layer (published in, for example, Phys, Rev. Lett., 41, 1492(1978)). However, the oxygen in this case enters from the beginning in the form in which it effectively extinguishes the localized states in the amorphous silicon. Unlike the peaks described above, therefore, the maximum infrared absorption peak value exists in the vicinity of approximately 930 $cm^{-1}$. Accordingly, such oxygen intentionally added in advance differs from the extrinsic oxygen forming the cause of the characteristics degradation as stated in this invention, and it forms no hindrance to the method of assessment of the amorphous silicon layer of this invention because of the unequal peak values.

Although the causes of the peaks are not clear in many points yet, it is presumed that the peak lying principally at 930 $cm^{-1}$ in the case of intentionally adding oxygen will be a bond in the form of (≡Si—O—), while the peaks changing with the lapse of time (at 1,140, 1,040, 650, 860 and 800 $cm^{-1}$) will be attributed to the bond of $SiO_2$.

Known well as methods for forming the amorphous silicon containing hydrogen (usually, denoted by a-Si:H) are (1) the glow discharge process based on the low-temperature decomposition of monosilane $SiH_4$, (2) the reactive sputtering process in which silicon is sputter-evaporated in an atmosphere containing hydrogen, (3) the ion-plating process, etc.

In order to vary the hydrogen content of the amorphous silicon layer, there may be controlled the substrate temperature, the concentration of hydrogen in an atmosphere, the input power, etc. in the case of forming the layer by the use of any of the various layer-forming methods.

With any of the processes, a layer having the best photoelectric conversion characteristics is obtained when the substrate temperature during the formation of the layer is 150°–250° C. In case of the glow discharge process, a layer of good photoelectric conversion characteristics has as low a resistivity as $10^6$–$10^7$ Ω·cm and is unsuitable for electrophotography. Therefore, such a consideration as doping the layer with a slight amount of boron to raise its resistivity is necessary. In contrast, the reactive sputtering process can produce a layer having a resistivity of at least $10^{10}$ Ω·cm besides good photoelectric conversion characteristics, and moreover, it can form a uniform layer of large area by employing a sputtering target of sufficiently large area. It can therefore be said particularly useful for forming the photoconductive layer for electrophotography.

Figure 2:
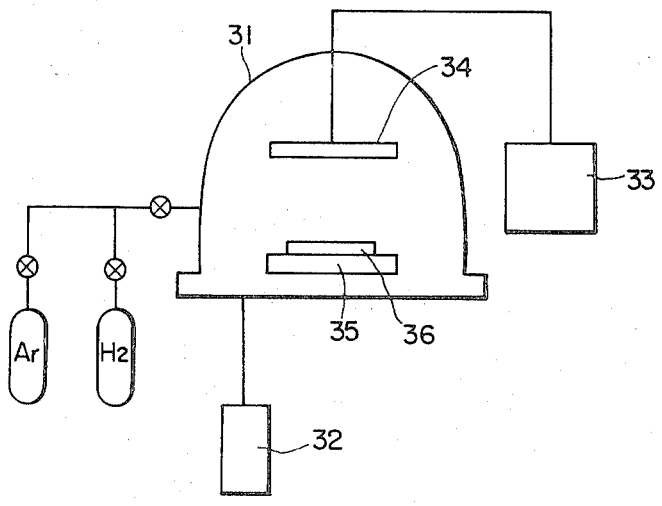
FIG. 2 is a schematic illustration for explaining a reactive sputtering equipment.

Usually, the reactive sputtering is performed by the use of an equipment as shown in FIG. 2. Referring to the figure, numeral 31 designates a bell jar, numeral 32 an evacuating system, numeral 33 a radio-frequency power source, numeral 34 a sputtering target, numeral 35 a substrate holder, and numeral 36 to a substrate. Sputtering equipment include, not only the structure which serves to perform the sputter-evaporation on the flat substrate as exemplified in the figure, but also a structure which can perform the sputter-evaporation on a cylindrical or drum-shaped substrate. Therefore, they may be properly employed according to intended uses.

The reactive sputtering is carried out by evacuating the bell jar 31, introducing hydrogen and such an inert gas as argon thereinto, and supplying a radio-frequency voltage from the radio-frequency power source 33 to cause a discharge. The quantity of hydrogen which is contained in a layer to be formed at this time is determined principally by the pressure of hydrogen existent in the atmosphere gas during the discharge. The amorphous silicon layer containing hydrogen as is suited to this invention is produced when the hydrogen pressure during the sputtering lies in a range of from $5\times10^{-5}$ Torr to $9\times10^{-3}$ Torr. Further, when the pressure of the atmosphere gas is suppressed below $1\times10^{-2}$ Torr, an amorphous silicon layer of good stability is obtained.

The lower limit of the pressure of the atmosphere gas suffices if the discharge can be maintained, and it is approximately $1\times10^{-4}$ Torr in case of employing the magnetron sputtering. As the deposition rate of the layer at this time, a value of 1 A/sec.–30 A/sec. is preferable.

Figure 3:
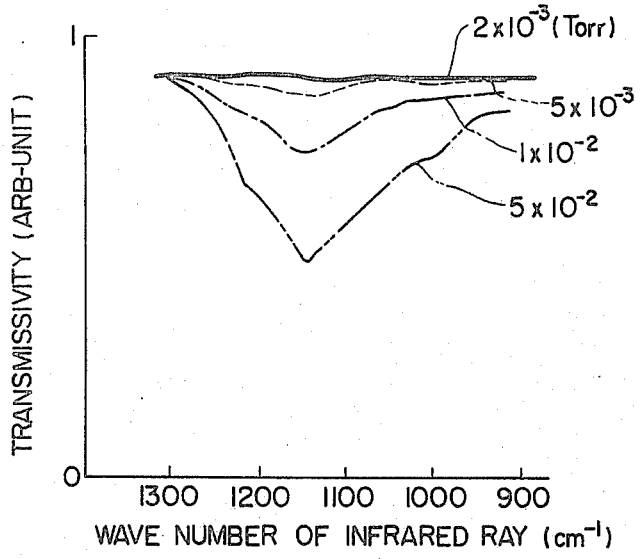
FIGS. 3 and 4 are graphs each showing the relationships between the pressure of an atmosphere gas at the preparation of amorphous silicon and the intensities of peaks contributive to the bond between silicon and oxygen.
Figure 4:
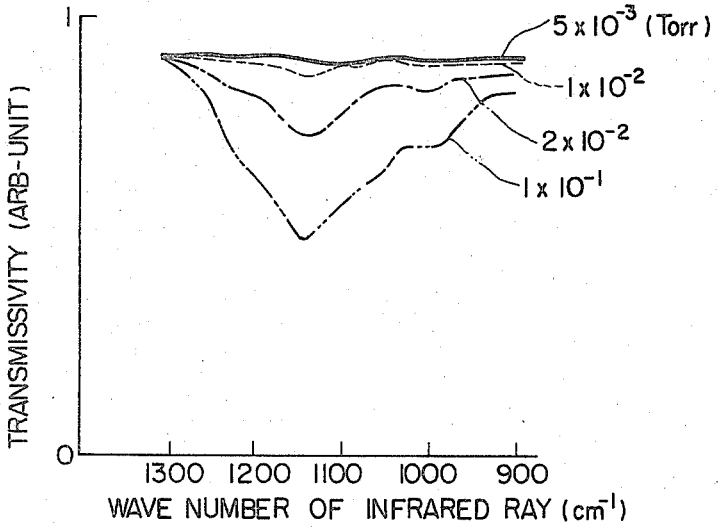

In case of preparing an amorphous silicon layer by the reactive sputtering process, it has been revealed that the layer liable to change in quality is formed when the pressure of the atmosphere gas during the reaction exceeds a certain value. FIGS. 3 and 4 show the circumstances with note especially taken of the peaks of 1,140 $cm^{-1}$ and 1,040 $cm^{-1}$. FIG. 3 illustrates samples produced by the conventional reactive sputtering process, while FIG. 4 illustrates samples produced by the magnetron sputtering process. It is understood that, even when the magnetron sputtering process is employed, the amorphous silicon prepared under the atmosphere gas of a pressure higher than $1\times10^{-2}$ Torr changes in quality. The peaks of 1,140 $cm^{-1}$ and 1,040 $cm^{-1}$ indicative of the bond between oxygen and silicon are noted to be great, and it is understood that the amorphous silicon layer has an unstable quality of easy oxidation. The amorphous silicon layer under such state cannot attain a resistivity of at least $10^{10}$ Ω·cm required for the electrophotographic member.

The limit pressure is somewhat dependent upon equipment. By way of example, with the so-called magnetron type sputtering wherein a magnetic field is applied to a target to confine a plasma so as to efficiently perform the sputtering reaction, it is possible to form a layer which does not change in quality even at a pressure somewhat higher than with the conventional reactive sputtering process. In that case, however, amorphous silicon of good quality could not be formed under a pressure in excess of $1\times10^{-2}$ Torr as stated above, either. With the mere reactive sputtering process, the limit pressure needs to be made $5\times10^{-3}$ Torr or less.

Figure 5:
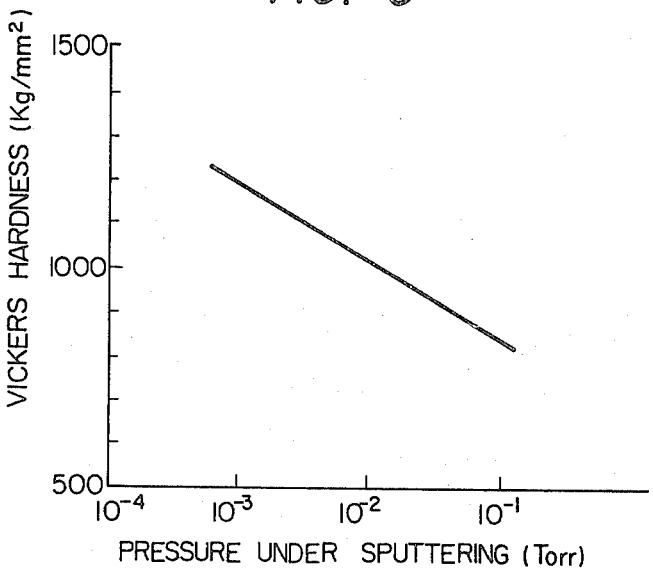
FIG. 5 is a graph showing the relationship between the sputtering atmosphere and the Vickers hardness of amorphous silicon.

On the other hand, when the Vickers hardness of an amorphous silicon layer formed by the magnetron type sputtering process was measured, there was obtained the result that it increases with the lowering of the atmosphere gas as shown in FIG. 5. Moreover, the layer produced by the magnetron type exhibits a higher hardness than a layer produced by the conventional sputtering. The hardness of the layer is considered to directly reflect the denseness of the structure of amorphous silicon. When it is therefore considered in correspondence with the atmosphere gas pressure and the variations of the infrared absorption peaks as stated before, it is understood that a value of at least 950 kg/mm$^2$ in terms of the Vickers hardness must be exhibited in order to make the amorphous silicon layer good in quality and usable for electrophotography.

As explained above, by specifying the quantity of hydrogen to be contained in the amorphous silicon layer and the optical forbidden band gap of the layer, a layer having the photoconductivity satisfactory for electrophotography can be realized. By taking note of the infrared absorption peaks of the bond between silicon and oxygen, a layer of good stability and high resistivity can be obtained. Whether or not the amorphous silicon layer is stable enough to endure use can be simply known by measuring the hardness of the layer. By employing these measures in combination, an amorphous silicon photoconductor layer having good electrophotographic characteristics can be obtained.

Hereunder, concrete structures of the electrophotographic member having the amorphous silicon photoconductor layer will be described.

Figure 6:
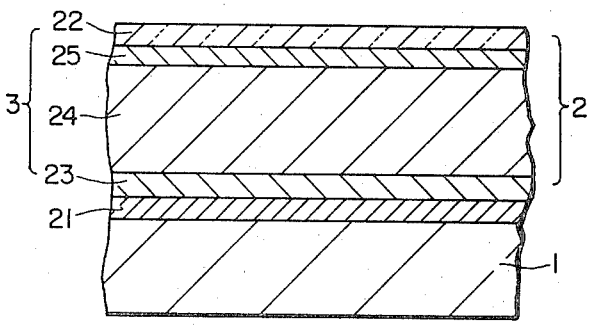
FIGS. 6 and 7 are views each showing the sectional structure of an electrophotographic member.
Figure 7:
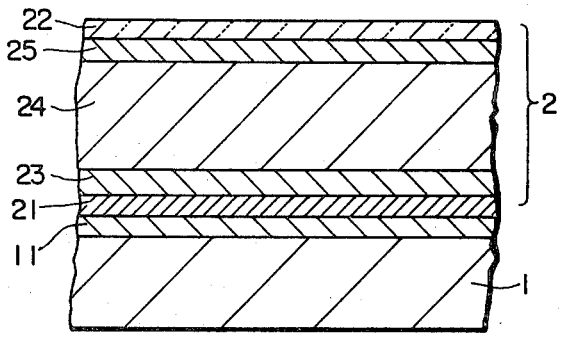

FIGS. 6 and 7 are sectional views of electrophotographic members. They correspond to a case where a substrate is made of a conductive material such as metal, and a case where a substrate is made of an insulator, respectively. In both the figures, the same numerals indicate the same parts.

Referring to FIG. 6, numeral 1 designates a substrate, and numeral 2 a photoconductive layer including an amorphous silicon layer. The substrate 1 may be any of a metal plate such as aluminum, stainless steel, nichrome, molybdenum, gold, niobium, tantalum or platinum plate; an organic material such as polyimide resin; glass; ceramics; etc. In case where the substrate 1 is an electrical insulator, an electrode 11 needs to be deposited thereon as shown in FIG. 7. Used as the electrode is a thin film of a metal material such as aluminum and chromium, or a transparent electrode of an oxide such as $SnO_2$ and In-Sn-O. The photoconductive layer 2 is disposed on the electrode. In case where the substrate 1 is light-transmissive and the electrode 11 is transparent, light to enter the photoconductive layer 2 may be projected through the substrate 1. The photoconductive layer 2 can be provided with a layer 21 for suppressing the injection of excess carriers from the substrate side, and a layer 22 for suppressing the injection of charges from the surface side. As the layers 21 and 22, layers of a high-resistivity oxide, sulfide or selenide such as SiO, $SiO_2$, $Al_2O_3$, $CeO_2$, $V_2O_3$, $Ta_2O$, $As_2Se_3$ and $As_2S_3$ are used, or layers of an organic substance such as polyvinyl carbazole are sometimes used. Although these layers 21 and 22 serve to improve the electrophotographic characteristics of the photoconductive layer of this invention, they are not always absolutely indispensable. All layers 23, 24 and 25 are layers whose principal constituents are amorphous silicon. The thickness of the amorphous silicon layer is generally 2 μm–70 μm, and often lies in a range of 20 μm–40 μm. Each of the layers 23 and 25 is an amorphous silicon layer which satisfies the characteristics of this invention described before and which has a thickness of at least 10 nm. Even when the resistivity of the layer 24 is below $10^{10}$ Ω·cm, no bad influence is exerted on the dark decay characteristics as the electrophotographic member owing to the presence of the layers 23 and 24. Although, in FIGS. 6 and 7, the amorphous silicon layer has the three-layered structure, it may of course be a generally uniform amorphous-silicon layer having the same properties as the foregoing surface (interface) layer. In order to vary the electrical or optical characteristics of amorphous silicon, a material in which part of silicon is substituted by carbon or germanium can also be used for the electrophotographic member. Useful as the quantity of the substitution by germanium or carbon is within 30 atomic-%. Further, the amorphous silicon layer is sometimes doped with a very small amount of boron or the like as may be needed. However, it is necessary for ensuring the photoconductivity that at least 50 atomic-% of silicon is contained on the average within the layer.

A protective film or the like may well be disposed on the surface of the amorphous silicon photoconductor. As the material of the protective film, a synthetic resin such as polyamide and polyethylene terephthalate is mentioned.

Figure 8:
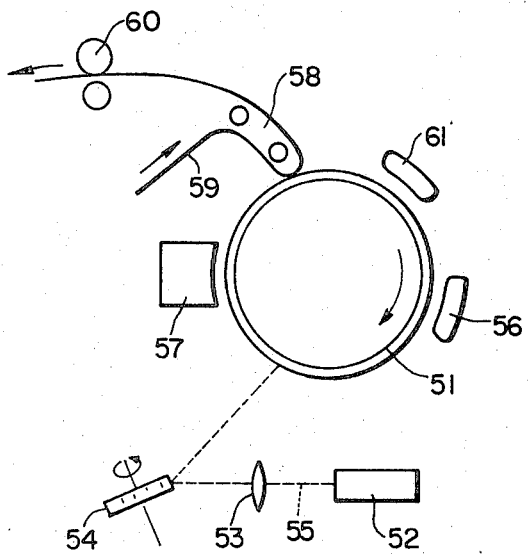
FIG. 8 is a schematic view showing the construction of a laser beam printer.

Referring to FIG. 8, the electrophotographic plate according to the present invention is formed on the surface of a rotary drum 51. When the rotary drum 51 is formed of a conductor such as aluminum, the rotary drum 51 per se may be used as the conductor substrate of the electrophotographic member according to the present invention. When a rotary drum formed of glass or the like is used, a conductor such as a metal is coated on the surface of the rotary drum of glass, and a plurality of predetermined amorphous Si layers are laminated thereon. Beams 55 from a light source 52 such as semiconductor laser pass through a beam collecting lens 53 and impinge on a polyhedral mirror 54, and they are reflected from the mirror 54 and reach the surface of the drum 51.

Charges induced on the drum 51 by a charger 56 are neutralized by signals imparted to the laser beams to form a latent image. The latent image region arrives at a toner station 57 where a toner adheres only to the latent image area irradiated with the laser beams. This toner is transferred onto a recording paper 59 in a transfer station 58. The transferred image is thermally fixed by a fixing heater 60. Reference numeral 61 represents a cleaner for the drum 51.

There may be adopted an embodiment in which a glass cylinder is used as the drum, a transparent conductive layer is formed on the glass cylinder and predetermined amorphous silicon layers are laminated thereon.

In this embodiment, the writing light source may be disposed in the cylindrical drum. In this case, beams are incident from the conductor side of the electrophotographic plate.

Needless to say, applications of the electrophotographic member are not limited to the above-mentioned embodiments.

In the instant specification and appended claims, by the term "electrophotographic member" is meant one that is used for an electrophotographic device, a laser beam printer equipment and the like in the fields of electrophotography, printing, recording and the like.

EXAMPLE 1

A concrete example will be described with reference to FIG. 6.

An aluminum cylinder whose surface was mirror-polished was heated at 300° C. in an oxygen atmosphere for 2 hours, to form an $Al_2O_3$ film 21 on the surface of the cylinder 1. The cylinder was installed in a rotary magnetron type sputtering equipment, the interior of which was evacuated up to $1\times10^{-6}$ Torr. Thereafter, whilst holding the cylinder at 200° C., a mixed gas consisting of neon and hydrogen was introduced $2\times10^{-3}$ Torr (hydrogen pressure: 30%). In the mixed atmosphere, an amorphous silicon layer 3 having a hydrogen content of 19 atomic-%, an optical forbidden band gap of 1.92 eV and a resistivity of $4\times10^{11}$ Ωcm was deposited to a thickness of 20 μm at a deposition rate of 2 A/sec by a radio-frequency output of 350 W (13.56 MHz). Thereafter, the resultant cylinder was taken out of the sputtering equipment and was installed in a vacuum evaporation equipment. Whilst holding the substrate temperature at 80° C. under a pressure of $2\times10^{-6}$ Torr, an $As_2Se_3$ film 22 was evaporated to a thickness of 1,000 A. The cylinder thus prepared was used as an electrophotographic sensitive drum. In this example, the amorphous silicon layer 3 was a single layer.

The infrared absorption spectrum of the amorphous silicon obtained was as shown by a curve A in FIG. 1. Further, in case where the electrophotographic member was subjected to corona discharge at 6.5 kV, an initial potential value held across both the ends of the member was 30 V/1 μm and was very preferable for the electrophotographic member.

On the other hand, an electrophotographic member produced in such a way that an amorphous silicon layer was formed by employing at the sputtering a mixed gas consisting of neon and hydrogen and having a pressure of $1\times10^{-2}$ Torr (hydrogen pressure: 30%), was $1\times10^{2}$ Ω·cm in the resistivity and below 1 V/1 μm in the initial potential value for the corona discharge. This comparative example was unfavorable on account of the low initial potential value. The infrared absorption spectrum of this amorphous silicon was as shown by a curve B in FIG. 1.

Figure 9:
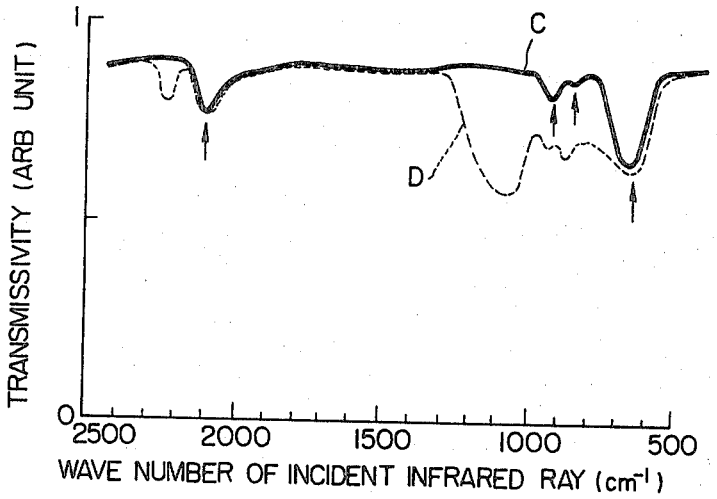

FIG. 9 shows the infrared absorption spectra of samples different from the material referred to in FIG. 1. The sample of a curve C was prepared by setting the mixed gas consisting of neon and hydrogen gas at $2\times10^{-3}$ Torr (hydrogen pressure: 55%), while the sample of a curve D was prepared by setting the mixed gas at $1\times10^{-2}$ Torr (hydrogen pressure: 55%). Unlike the example shown in FIG. 1, in both the samples of the curves C and D, only an infrared absorption peak at a wave number of 2,100 $cm^{-1}$ is clear, and a peak at 2,000 $cm^{-1}$ is hardly noted. In both the samples, the hydrogen content was 12 atomic-%, and the band gap was approximately 1.95 eV.

Also in such case, the sample of the curve C can ensure a satisfactory surface potential, and its characteristics exhibit very small changes versus time and are stable.

In contrast, in the sample of the curve D, the infrared absorption peak of a wave number of 1,140 $cm^{-1}$ attributed to the bond between silicon and oxygen is greater than the peak of the wave number of 2,100 $cm^{-1}$ attributed to the bond between silicon and hydrogen. This sample cannot secure a satisfactory surface potential, and its characteristics exhibit very great changes versus time.

Figure 10:
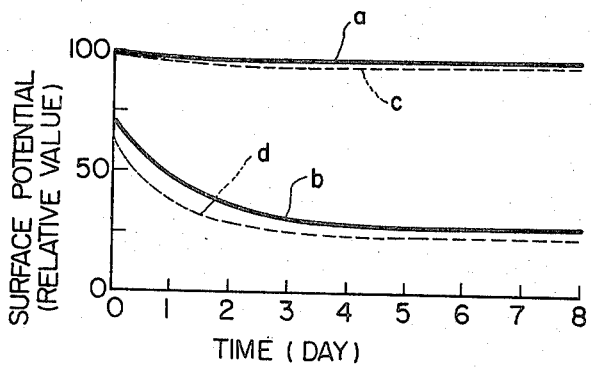
FIG. 10 is a graph showing the variations-with-time of the surface potentials of several amorphous silicon layers.

FIG. 10 compares and illustrates how the samples of the curves A and B in FIG. 1 and the curves C and D in FIG. 2 can ensure surface potentials. Curves a, b, c and d in FIG. 10 show the characteristics changes of the samples A, B, C and D, respectively.

After charging each electrophotographic member by the corona discharge at 6.5 kV, its surface potential was measured upon lapse of 1 sec. A higher surface potential signifies that more charges are held. Values at various times were obtained by keeping the electrophotographic member in the air and measuring its surface potential anew after, for example one day. It is understood from FIG. 10 that the samples belonging to the present invention exhibit very stable characteristics.

Regarding the extent of dark decay, the samples belonging to this invention exhibit values of below 10% of the surface potential after 1 sec., whereas the materials in which the peaks appear in correspondence with the bond between silicon and oxygen exhibit values of above 30% and cannot be put into practical use.

The stable characteristics could be obtained in the foregoing case where at least one of peaks in the infrared absorption characteristics having centers at 2,200 $cm^{-1}$, 1,140 $cm^{-1}$, 1,040 $cm^{-1}$, 650 $cm^{-1}$, 860 $cm^{-1}$ and 800 $cm^{-1}$ did not exceed 20% of the intensity of the greater one between the peaks at the wave numbers of 2,100 $cm^{-1}$ and 2,000 $cm^{-1}$.

EXAMPLE 2

Likewise to Example 1, an aluminum cylinder was used as a substrate 1, and it was heat-treated in an oxygen atmosphere to form an $Al_2O_3$ film 21 on the surface of the cylinder to a thickness of 500 A. The cylinder was installed in a rotary magnetron type sputtering equipment, the interior of which was evacuated up to $1\times10^{-6}$ Torr. Thereafter, whilst holding the cylinder at 200° C., a mixed gas under $2\times10^{-3}$ Torr consisting of neon and hydrogen was introduced. The hydrogen pressure was 30%. In the atmosphere, a radio-frequency output of 350 W (13.56 MHz) was applied to the equipment, and a first amorphous silicon layer 23 was formed to a thickness of 10 nm at a deposition rate of approximately 2 A/sec. This amorphous silicon had a hydrogen content of 20 atomic-%, an optical forbidden band gap of 1.95 eV, and a resistivity of $3.5\times10^{11}$ Ω·cm, and its infrared absorption spectrum was the curve A in FIG. 1.

Subsequently, whilst gradually varying the hydrogen pressure from 30% to 5% with the pressure of the mixed gas held at $2\times10^{-3}$ Torr, the deposition of amorphous silicon was continued. After the partial pressure reached 5%, the quantity of hydrogen was gradually increase and returned to the partial pressure of 30% again. The deposition rate was substantially constant in this hydrogen pressure range, and a region with the varying hydrogen content became approximately 25 nm thick by performing the above operations in 2 minutes. In this region (second layer 24), the part deposited under the condition of the hydrogen pressure of 5% assumed a hydrogen content of 10 atomic-%, a minimum forbidden band gap of 1.5 eV and a minimum resistivity of $5\times10^9$ Ω·cm, and the first and last parts assumed the same values as the first layer. In the infrared spectrum of the second layer, the peak attributed to the Si-O bond was not observed as in that of the first layer.

Thereafter, a third amorphous silicon layer was deposited to a thickness of 25 μm under the same conditions as those of the first layer. In case where the cylinder thus formed was used as an electrophotographic sensitive drum, a potential of 600 V could be held after corona charging owing to the high resistivities of the first and third layers, and a semiconductor laser source of 7,500 A could be used owing to the second layer.

What is claimed is:

1. In an electrophotographic member having at least a supporter and a photoconductor layer which is principally formed of amorphous silicon; an electrophotographic member characterized in that said amorphous silicon contains at least 50 atomic-% of silicon and at least 1 atomic-% of hydrogen as an average within said layer, and that a part which is at least 10 nm thick from a surface or/and interface of said photoconductor layer toward the interior of said photoconductor layer has a hydrogen content in a range of at least 1 atomic-% to at most 40 atomic-% and an optical forbidden band gap in a range of at least 1.3 eV to at most 2.5 eV and also has the property that an intensity of at least one of peaks having centers at wave numbers of approximately 2,200 $cm^{-1}$, approximately 1,140 $cm^{-1}$, approximately 1,040 $cm^{-1}$, approximately 650 $cm^{-1}$, approximately 860 $cm^{-1}$ and approximately 800 $cm^{-1}$ in an infrared absorption spectrum which are attributed to a bond between silicon and oxygen does not exceed 20% of a higher one of the intensitites of peaks having centers at wave numbers of approximately 2,000 $cm^{-1}$ and approximately 2,100 $cm^{-1}$ which are attributed to a bond between silicon and hydrogen.

2. An electrophotographic member according to claim 1, wherein said amorphous silicon layer contains at least one element selected from the group consisting of germanium and carbon.

3. An electrophotographic member according to claim 1 or claim 2, wherein said amorphous silicon layer consists of at least three layers, and each of a top layer and a bottom layer of said at least three layers is at least 10 nm thick and has the same hydrogen content, optical forbidden band gap and property as those of said part.

4. An electrophotographic member according to claim 1, wherein said part has a resistivity of at least $10^{10}$ Ω·cm.

5. An electrophotographic member according to claim 1, wherein said amorphous silicon layer is formed by a reactive sputtering process in an atmosphere containing hydrogen.

6. An electrophotographic member according to claim 1, wherein said photoconductor layer is provided with a protective film disposed on a surface thereof, said protective film being formed of a synthetic resin.

7. An electrophotographic member according to claim 6, wherein said synthetic resin comprises polyamide or polyethylene terephthalate.

* * * * *